US007581999B2

(12) United States Patent
Ryu et al.

(10) Patent No.: US 7,581,999 B2
(45) Date of Patent: Sep. 1, 2009

(54) ELECTRON EMISSION DEVICE HAVING OPENINGS WITH IMPROVED ASPECT RATIO AND METHOD OF MANUFACTURING

(75) Inventors: Kyung-Sun Ryu, Suwon-si (KR); Seong-Yeon Hwang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 674 days.

(21) Appl. No.: 11/191,880

(22) Filed: Jul. 27, 2005

(65) Prior Publication Data

US 2006/0022575 A1 Feb. 2, 2006

(30) Foreign Application Priority Data

Jul. 30, 2004 (KR) ..... 10-2004-0060600

(51) Int. Cl.
*H01J 9/24* (2006.01)

(52) U.S. Cl. ..... 445/24; 445/50

(58) Field of Classification Search ..... 445/24, 445/50; 313/495

See application file for complete search history.

(56) References Cited

U.S. PATENT DOCUMENTS 5,319,279 A 6/1994 Watanabe et al.
6,075,269 A * 6/2000 Terasawa et al. ..... 257/330
6,356,014 B2 * 3/2002 Xu et al. ..... 313/497
6,379,210 B2 * 4/2002 Xu et al. ..... 445/50
6,489,710 B1 * 12/2002 Okita et al. ..... 313/309
6,733,355 B2 * 5/2004 Hwang et al. ..... 445/24
2003/0082983 A1 * 5/2003 Hwang et al. ..... 445/24
2004/0108515 A1 * 6/2004 Muroyama et al. ..... 445/24
2006/0022577 A1 * 2/2006 Kim ..... 313/497

* cited by examiner

*Primary Examiner*—Peter Macchiarolo
(74) *Attorney, Agent, or Firm*—Christie Parker & Hale LLP

(57) ABSTRACT

In a method of manufacturing an electron emission device, cathode electrodes are first formed on a substrate. An insulating layer is formed on the entire surface of the substrate such that the insulating layer covers the cathode electrodes. The insulating layer is wet-etched two or more times such that openings each with an aspect ratio of more than 1 are formed in the insulating layer. Gate electrodes are formed on the insulating layer. Electron emission regions are formed on the cathode electrodes within the openings of the insulating layer. The respective etchings are conducted using separate mask patterns with the same-sized openings such that under-cuts are made.

16 Claims, 5 Drawing Sheets

ELECTRON EMISSION DEVICE HAVING OPENINGS WITH IMPROVED ASPECT RATIO AND METHOD OF MANUFACTURING

CROSS REFERENCE TO RELATED APPLICATION

This application claims priority to and the benefit of Korean Patent Application No. 10-2004-0060600 filed on Jul. 30, 2004 in the Korean Intellectual Property Office, the entire content of which is incorporated herein by reference.

BACKGROUND OF THE INVENTION

1. Field of the Invention

The embodiments of the present invention relate to an electron emission device and a method of manufacturing the device, and in particular, to an electron emission device having an insulating layer with high aspect ratio openings and a manufacturing method thereof.

2. Description of Related Art

Generally, electron emission devices are classified into a first type where a hot cathode is used as an electron emission source and a second type where a cold cathode is used as the electron emission source.

Among the second type of electron emission devices are devices known as field emitter array (FEA) type devices, surface-conduction emission (SCE) type devices, metal-insulator-metal (MIM) type devices, and metal-insulator-semiconductor (MIS) type devices.

The FEA type electron emission devices are based on the principle that when a material having a low work function or a high aspect ratio is used as the electron emission source, electrons are easily emitted from the material in a vacuum when exposed to an electric field. A sharp-pointed tip structure including molybdenum (Mo) or silicon (Si) or a carbonaceous material, such as carbon nanotube, graphite and diamond-like carbon, has been developed to be used as the electron emission source.

In the FEA type electron emission devices, cathode electrodes, an insulating layer and gate electrodes are sequentially formed on a first substrate and openings are formed in the gate electrodes and the insulating layer. Electron emission regions are formed on the cathode electrodes within the openings. Phosphor layers and an anode electrode are formed on a surface of a second substrate facing the first substrate.

The insulating layer is formed through repeating a screen printing, drying and firing process several times such that it has a thickness of 5-30 μm. The insulating layer is patterned through wet etching to form openings. With the wet etching, as the etching is made in an isotropic manner, the insulating layer is etched in a horizontal direction as well as in a vertical direction. Accordingly, the width of the opening becomes larger than the depth of the opening, and as a result, the opening has an aspect ratio of 1 or less.

Such a phenomenon is more seriously manifested as the thickness of the insulating layer is increased and becomes a critical factor in making it difficult to conduct the micro patterning process. Accordingly, the pixels are not easily arranged on the first substrate in a compact manner and a desired high resolution display screen is not obtainable. As the number of electron emission regions arranged within a predetermined area of pixels is limited, it becomes difficult to emit a suitable amount of electrons.

SUMMARY

In one exemplary embodiment of the present invention, there is provided an electron emission device and a method of manufacturing the electron emission device, which increases the aspect ratio of the openings formed in the insulating layer to enable the micro patterning, and enables the attainment of high resolution and high luminance.

In an exemplary embodiment of the present invention, in a method of manufacturing the electron emission device, cathode electrodes are first formed on a substrate. An insulating layer is formed on the entire surface of the substrate such that the insulating layer covers the cathode electrodes. The insulating layer is wet-etched two or more times to form openings in the insulating layer each with an aspect ratio of more than 1. Gate electrodes are formed on the insulating layer. Electron emission regions are formed on the cathode electrodes within the openings of the insulating layer.

The etchings may be conducted using separate mask patterns having the same-sized openings. The etchings may be conducted such that under-cuts are made.

In another exemplary embodiment of the present invention, in a method of manufacturing the electron emission device, cathode electrodes are first formed on a substrate. An insulating layer is formed on the entire surface of the substrate such that the insulating layer covers the cathode electrodes. A first mask pattern with openings is formed on the insulating layer. The portions of the insulating layer exposed through the openings of the first mask pattern are first etched by wet etching and the first mask pattern is removed. A second mask pattern is formed on the insulating layer. The second mask pattern has openings with the same size as the openings of the first mask pattern. The portions of the insulating layer exposed through the openings of the second mask pattern are etched a second time by wet etching and the second mask pattern is removed. A third mask pattern is formed on the insulating layer. The third mask pattern has openings with the same size as the openings of the first mask pattern. The portions of the insulating layer exposed through the openings of the third mask pattern are etched a third time by wet etching and the third mask pattern is removed. Gate electrodes are formed on the insulating layer. Electron emission regions are formed on the cathode electrodes within the openings of the insulating layer.

The first etching may be conducted to remove ⅓ of the thickness of the insulating layer. The second etching may be conducted to remove ½ of the thickness of the remaining insulating layer. The first, the second and the third etchings may be conducted such that under-cuts are made.

In a further exemplary embodiment of the present invention, the electron emission device includes a first and a second substrate facing each other at a predetermined distance, cathode electrodes formed on the first substrate, and electron emission regions formed on the cathode electrodes. An insulating layer is formed on the cathode electrodes with openings having an aspect ratio of more than 1. The openings of the insulating layer are formed at the respective electron emission region formation locations. Gate electrodes are formed on the insulating layer. Phosphor layers are formed on the second substrate. At least one anode electrode is formed on a surface of the phosphor layers. The insulating layer may have a thickness of 5-30 μm.

DETAILED DESCRIPTION

Figure 1A:
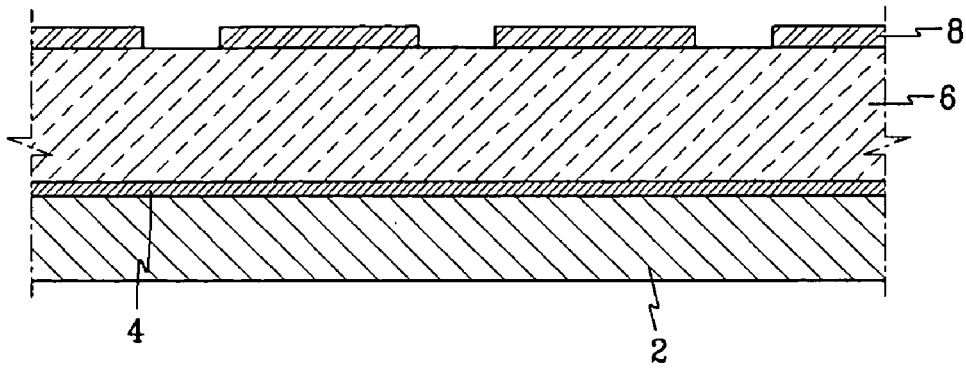
FIG. 1A is a diagram of a first phase in one embodiment of a process of manufacturing an electron emission device.

As shown in FIG. 1A, cathode electrodes 4 are first formed laid out in a first direction on a first substrate 2 and an insulating layer 6 is formed on the entire surface of the first substrate 2 such that it covers the cathode electrodes 4. The formation of the insulating layer 6 is made by repeating process of screen printing, drying and firing such that the insulating layer 6 has a thickness of 5-30 μm.

Thereafter, a first mask pattern with openings 81 is formed on the insulating layer 6. The first mask pattern 8 may be formed with a photosensitive film, which is patterned through a photolithography process using an exposure mask (not shown) to thereby form openings 81.

Figure 1B:
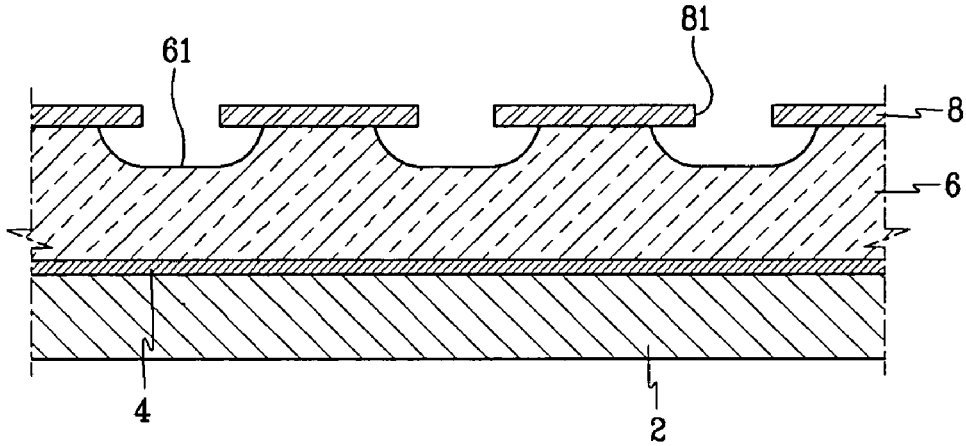
FIG. 1B is a diagram of a second phase in one embodiment of a process of manufacturing an electron emission device.

As shown in FIG. 1B, the portions of the insulating layer 6 exposed through the openings 81 of the first mask pattern 8 are wet-etched by a predetermined thickness to thereby form first etched portions 61. In this process, the etching is performed such that under-cuts are made under the first mask pattern 8. In this way, the maximum width of the first etched portion 61 is established to be larger than the width of the opening 81 of the first mask pattern 8. The insulating layer 6 is etched by ⅓ of the previous thickness to thereby form the first etched portions 61. After the formation of the first etched portions 61, the first mask pattern 8 is removed.

Figure 1C:
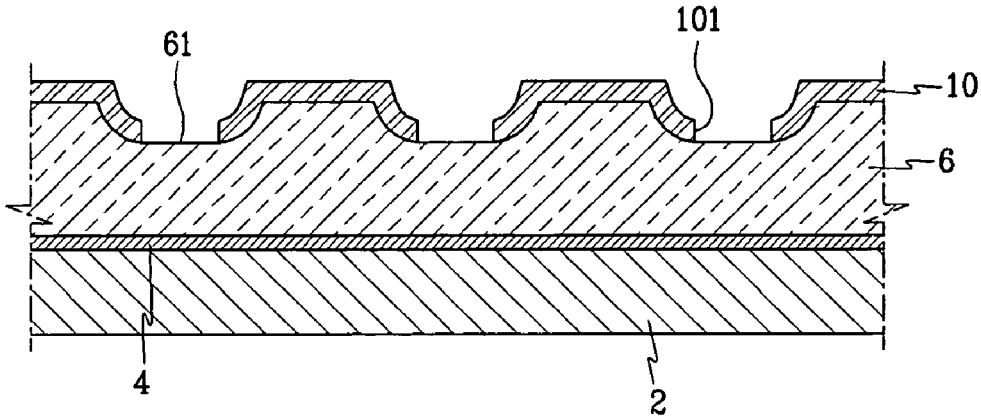
FIG. 1C is a diagram of a third phase in one embodiment of a process of manufacturing an electron emission device.

As shown in FIG. 1C, a second mask pattern 10 with openings 101 is formed on the insulating layer 6. The second mask pattern 10 may also be formed with a photosensitive film, which is patterned through a photolithography process using an exposure mask (not shown) to thereby form openings 101. The exposure mask is the same as that used in forming the first mask pattern 8. Accordingly, the opening 101 of the second mask pattern 10 has the same size as that of the opening 81 of the first mask pattern 8. The second mask pattern 10 covers the sidewalls of the first etched portions 61.

Figure 1D:
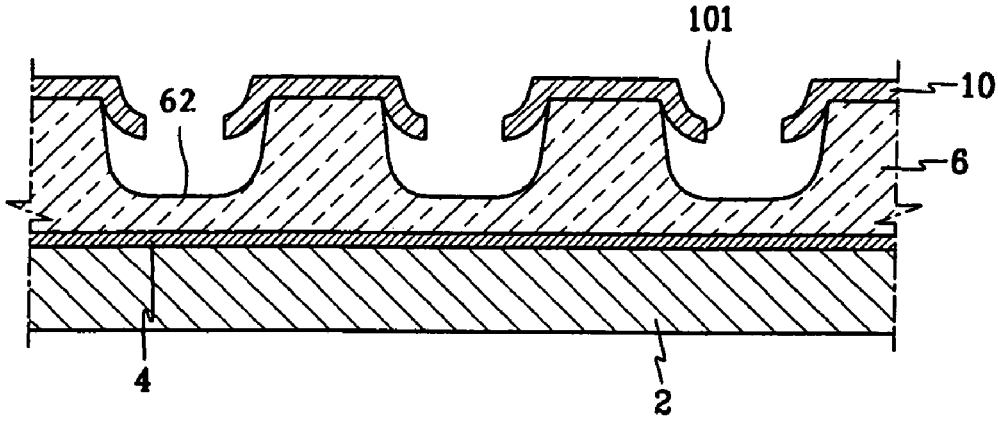
FIG. 1D is a diagram of a fourth phase in one embodiment of a process of manufacturing an electron emission device.

As shown in FIG. 1D, the portions of the insulating layer 6 exposed through the openings 101 of the second mask pattern 10 are wet-etched by a predetermined thickness to thereby form second etched portions 62. Even in this process, the etching is performed such that under-cuts are made under the second mask pattern 10. In this way, the maximum width of the second etched portion 62 is established to be larger than the width of the opening 101 of the second mask pattern 10. The remaining insulating layer 6 may be etched by ½ of the previous thickness to thereby form the second etched portions 62. After the formation of the second etched portions 62, the second mask pattern 10 is removed.

Figure 1E:
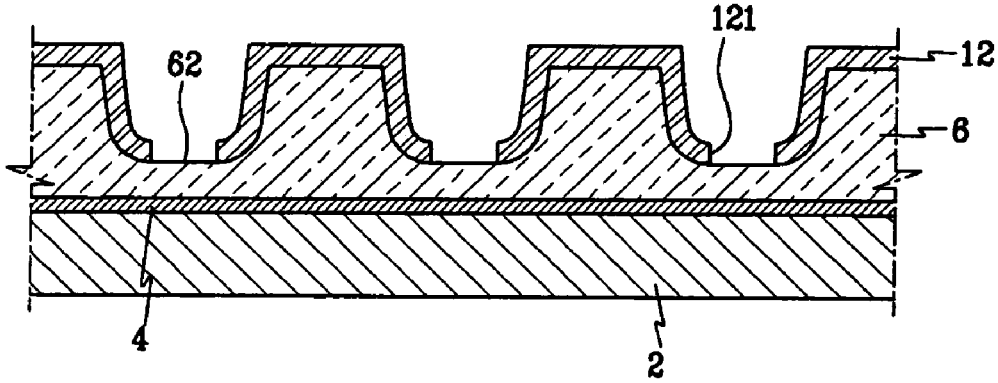
FIG. 1E is a diagram of a fifth phase in one embodiment of a process of manufacturing an electron emission device.

As shown in FIG. 1E, a third mask pattern 12 with openings 121 is formed on the insulating layer 6. The opening 121 of the third mask pattern 12 also has the same size as that of the opening 101 of the second mask pattern 10. For this purpose, the third mask pattern 12 is formed with a photosensitive film, which is patterned through a photolithography process using the same exposure mask as that used in forming the second mask pattern 10. Accordingly, the third mask pattern 12 covers the sidewalls of the second etched portions 62.

Figure 1F:
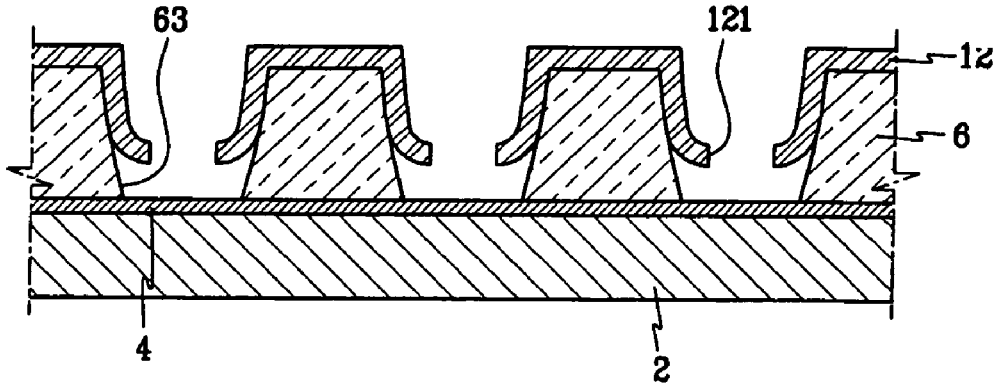
FIG. 1F is a diagram of a sixth phase in one embodiment of a process of manufacturing an electron emission device.

As shown in FIG. 1F, the portions of the insulating layer 6 exposed through the openings 121 of the third mask pattern 12 are completely etched to thereby form third etched portions 63 exposing the cathode electrodes 4. Even in this process, the etching is made such that under-cuts are made under the third mask pattern 12. In this way, the maximum width of the third etched portions 63 is established to be larger than the width of the opening 121 of the third mask pattern 12.

Figure 1G:
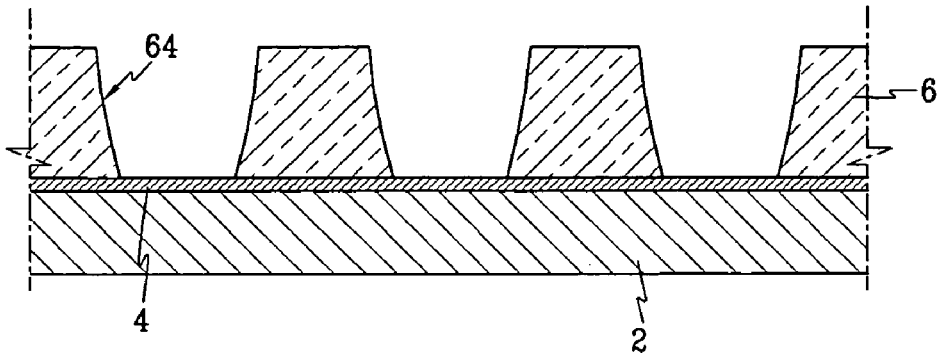
FIG. 1G is a diagram of a seventh phase in one embodiment of a process of manufacturing an electron emission device.

As shown in FIG. 1G, the third mask pattern 12 is removed to thereby complete the openings 64 of the insulating layer 6. In this way, the openings 64 are formed in the insulating layer 6 by repeating the photolithography process as well as the wet etching process three times and each completed opening 64 has an aspect ratio of more than 1.

It is set forth above that the formation of the openings 64 in the insulating layer 6 is made by repeating the photolithography process as well as the wet etching process three times, but it is possible that depending upon the thickness of the insulating layer 6, the photolithography process and the etching process are conducted only two times, or four or more times.

Figure 1H:
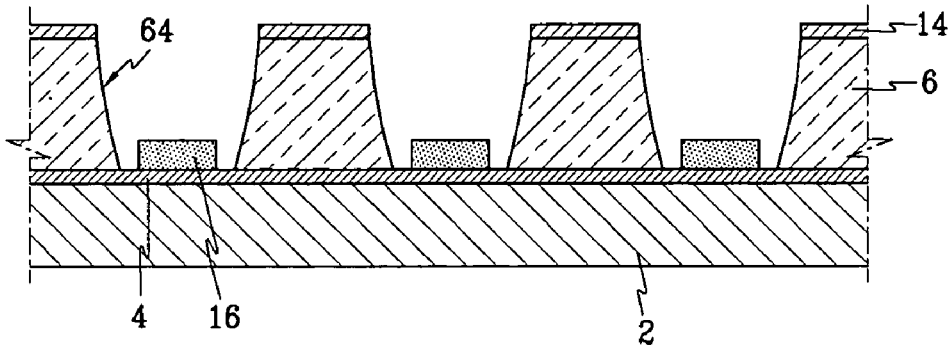
FIG. 1H is a diagram of a eighth phase in one embodiment of a process of manufacturing an electron emission device.

As shown in FIG. 1H, gate electrodes 14 are formed on the insulating layer 6 and electron emission regions 16 are formed within the openings 64 of the insulating layer 6. The electron emission regions 16 are formed with a material that emits electrons when an electric field is applied thereto in a vacuum, such as a carbonaceous material or a nanometer-sized material. The electron emission regions 16 may be formed with carbon nanotube, graphite, graphite nanofiber, diamond, diamond-like carbon, $C_{60}$, silicon nanowire or a combination thereof.

To form the electron emission regions 16, an organic material such as a vehicle and/or a binder is mixed with an electron emission material to prepare a paste-phased mixture with a viscosity suitable for the printing. The mixture is screen-printed onto the target, dried and fired. Alternatively, with the formation of the electron emission regions 16, a photosensitive material is added to the paste-phased mixture to form a new mixture and the mixture is screen-printed onto the entire surface of the first substrate and partially hardened. The non-hardened mixture is removed through developing. The electron emission regions 16 may be formed using the technique of direct growth, chemical vapor deposition or sputtering.

Figure 2:
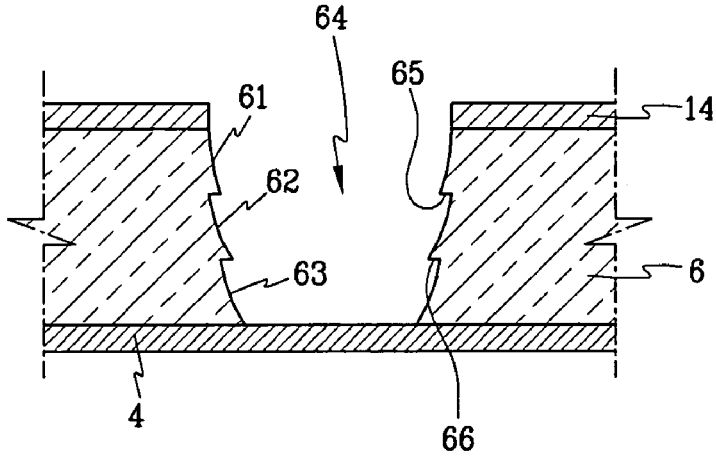
FIG. 2 is a partial cross-sectional view of an insulating layer for the electron emission device according to one embodiment of the present invention.

As described above, the openings 64 each with an aspect ratio of more than 1 can be easily formed in the insulating layer 6 by repeating the photolithography process and the wet etching process two or more times. With the completed opening 64, as shown in FIG. 2, a first boundary portion 65 is disposed between the sidewall of the first etched portion 61 and the sidewall of the second etched portion 62 such that it is inclined against those sidewalls at a predetermined angle. A second boundary portion 66 is disposed between the sidewall of the second etched portion 62 and the sidewall of the third etched portion 63 such that it is inclined against those sidewalls at a predetermined angle.

Figure 3:
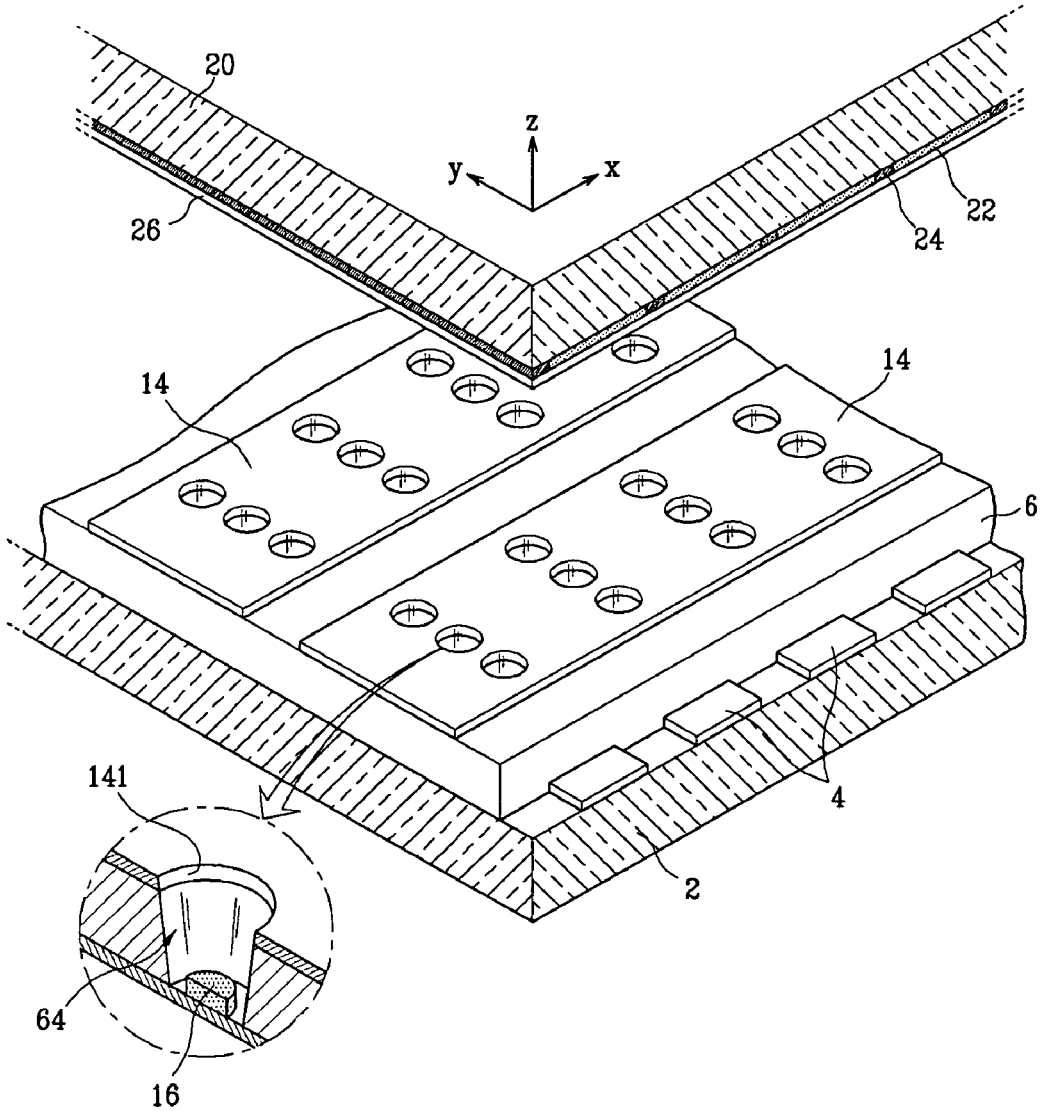
FIG. 3 is a partially exploded perspective view of an electron emission device according to one embodiment of the present invention.
Figure 4:
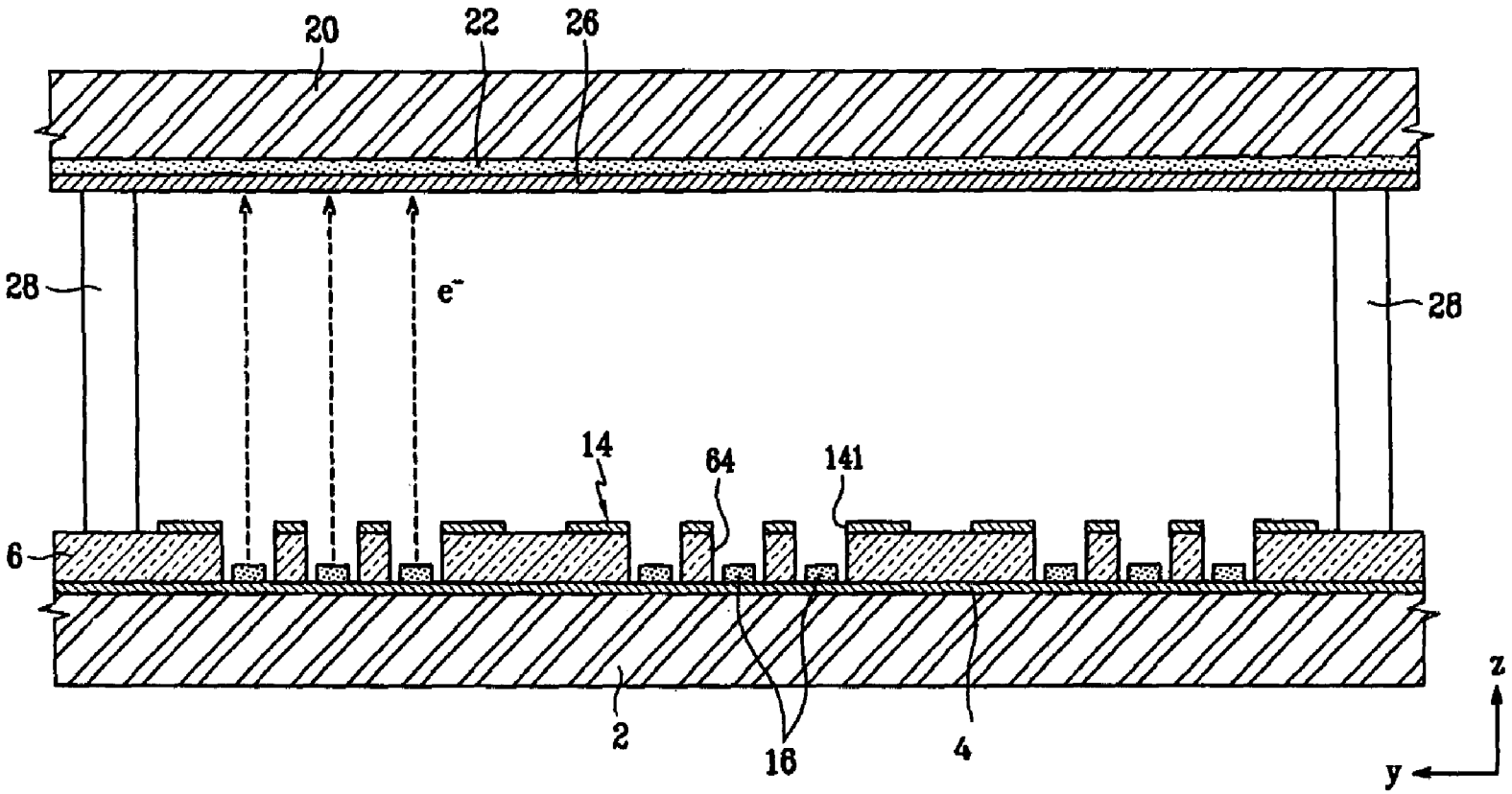
FIG. 4 is a partial cross-sectional view of the electron emission device according to one embodiment of the present invention.

As shown in FIGS. 3 and 4, the electron emission device includes a first substrate 2 and a second substrate 20 facing each other at a predetermined distance. An electron emission structure is provided on the first substrate 2 to emit electrons. A light emission or display structure is on the second substrate 20 to emit visible rays generated by the electrons from the electron emission structure, thereby making light emissions or displaying a desired image.

Cathode electrodes 4 are laid out in a stripe pattern on the first substrate 2 in one direction (in the direction of the y axis of the drawing). An insulating layer 6 is formed on the entire surface of the first substrate 2, covering the cathode electrodes 4. Gate electrodes 14 are patterned as stripes on the insulating layer 6 perpendicular to the cathode electrodes 4 (in the direction of the x axis of the drawing).

The regions where the cathode and the gate electrodes 4 and 14 cross make a formation of sub-pixel regions. Electron emission regions 16 are formed on the cathode electrodes 4 in the respective sub-pixel regions. Openings 64 and 141 are formed in the insulating layer 6 and the gate electrodes 14 corresponding to the respective electron emission regions 16, exposing the electron emission regions 16 on the first substrate 2.

The electron emission regions 16 are formed with a material that emits electrons when an electric field is applied thereto in a vacuum, such as a carbonaceous material or a nanometer-sized material. The electron emission regions 16 may be formed with carbon nanotube, graphite, graphite nanofiber, diamond, diamond-like carbon, $C_{60}$, silicon nanowire, or a combination thereof. The formation of the electron emission regions 16 may be made using the technique of screen printing, direct growth, chemical vapor deposition or sputtering.

It is illustrated in the drawings that the electron emission regions 16 are circular-shaped and linearly arranged along the length of the cathode electrode 4 in the respective sub-pixel regions. However, the shape of the emission regions 16, number of regions 16 per sub-pixel and arrangement of the electron emission regions 16 are not limited thereto, but may be altered in various manners.

Red, green and blue phosphor layers 22 are formed on a surface of the second substrate 20 facing the first substrate 2 at a set distance and black layers 24 are formed between the neighboring phosphor layers 22 to enhance the screen contrast. An anode electrode 26 is formed on the phosphor layers 22 and the black layers 24 with a metallic layer containing aluminum (Al). The anode electrode 26 receives a high voltage required for accelerating the electron beams from the outside and reflects the visible rays radiated from the phosphor layers 22 toward the first substrate 2 to the second substrate 20, thereby increasing the screen luminance.

Alternatively, the anode electrodes may be formed with a transparent conductive film based on indium tin oxide (ITO), instead of the metallic layer. In this embodiment, the anode electrode is formed on a surface of the phosphor layers and the black layers facing the second substrate. The anode electrode may be patterned with a plurality of portions.

Spacers 28 are arranged between the first and the second substrates 2 and 20. The first and the second substrates 2 and 20 are sealed to each other at their peripheries using a sealant, such as a glass frit. The inner space between the first and the second substrates 2 and 20 is evacuated to be a vacuum, thereby constructing an electron emission device.

The above-structured electron emission device is driven by applying predetermined voltages to the cathode electrodes 4, the gate electrodes 14 and the anode electrode 26. For instance, driving voltages with a voltage difference of several to several tens of volts are applied to the cathode and the gate electrodes 4 and 14, and a positive (+) voltage of several hundreds to several thousands of volts is applied to the anode electrode 26.

Electric fields are formed around the electron emission regions 16 at the pixels where the voltage difference between the cathode and the gate electrodes 4 and 14 exceeds a threshold value and electrons are emitted from those electron emission regions 16. The emitted electrons are attracted by the high voltage applied to the anode electrode 26, thereby colliding against the corresponding phosphor layers 22 and causing light to emit from them.

In the electron emission device according to the embodiments of the present invention, as the opening 64 is formed in the insulating layer 6 by the above-described method, the depth of the opening 64 is established to be larger than the width thereof and as a result, the opening 64 has a high aspect ratio of more than 1.

In the electron emission structure that is formed on the first substrate 2, the micro patterning creates a large number of electron emission regions 16 that can be arranged within the limited sub-pixel area or the sub-pixel area can be minimized or reduced. In the former case, the amount of emitted electrons is increased to effectively increase the screen luminance. In the latter case, a desired high resolution can be easily achieved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of manufacturing an electron emission device, the method comprising:

(a) forming cathode electrodes on a substrate;

(b) forming an insulating layer on the substrate such that the insulating layer covers the cathode electrodes;

(c) forming a mask pattern on the insulating layer;

(d) wet-etching the insulating layer;

(e) removing the mask pattern;

(f) repeating (c) through (e) two or more times such that openings each with an aspect ratio of more than 1 are formed in the insulating layer;

(g) forming gate electrodes on the insulating layer; and (h) forming electron emission regions on the cathode electrodes within the openings of the insulating layer.

2. The method of claim 1, wherein each mask pattern has a same-sized opening as each other mask pattern.

3. The method of claim 2, wherein the repeating (c) through (e) two or more times comprises utilizing an identical exposure pattern to from each mask pattern through photolithography.

4. The method of claim 2, wherein the etchings are conducted such that under-cuts are made.

5. An electron emission device manufactured by the method of claim 1, wherein the insulating layer has one or more boundary portions formed at a sidewall of at least one of the openings formed in the insulating layer.

6. An electron emission device manufactured by the method of claim 2, wherein the insulating layer has one or more boundary portions formed at a sidewall of at least one of the openings formed in the insulating layer.

7. An electron emission device manufactured by the method of claim 3, wherein the insulating layer has one or more boundary portions formed at a sidewall of at least one of the openings formed in the insulating layer.

8. An electron emission device manufactured by the method of claim 4, wherein the insulating layer has one or more boundary portions formed at a sidewall of at least one of the openings formed in the insulating layer.

9. A method of manufacturing an electron emission device, the method comprising:

(a) forming cathode electrodes on a substrate;

(b) forming an insulating layer on the substrate such that the insulating layer covers the cathode electrodes;

(c) forming a first mask pattern with openings on the insulating layer;

(d) first etching portions of the insulating layer exposed through the openings of the first mask pattern by wet etching and removing the first mask pattern;

(e) forming a second mask pattern on the insulating layer, the second mask pattern having openings with a same size as the openings of the first mask pattern;

(f) second etching portions of the insulating layer exposed through the openings of the second mask pattern by wet etching and removing the second mask pattern;

(g) forming a third mask pattern on the insulating layer, the third mask pattern having openings with the same size as the openings of the first mask pattern;

(h) third etching portions of the insulating layer exposed through the openings of the third mask pattern by wet etching and removing the third mask pattern;

(i) forming gate electrodes on the insulating layer; and (j) forming electron emission regions on the cathode electrodes within openings of the insulating layer formed by the etchings.

10. The method of claim 9, wherein the first etching is conducted such that ⅓ of a thickness of the insulating layer is removed and the insulating layer has a remaining thickness.

11. The method of claim 10, wherein the second etching is conducted such that ½ of the remaining thickness of the insulating layer is removed.

12. The method of claim 9, wherein the first etching, the second etching and the third etching are conducted such that under-cuts are made.

13. An electron emission device manufactured by the method of claim 9, wherein at least one of the openings of the insulating layer has an aspect ratio of more than 1.

14. An electron emission device manufactured by the method of claim 10, wherein at least one of the opening of the insulating layer has an aspect ratio of more than 1.

15. An electron emission device manufactured by the method of claim 11, wherein at least one of the openings of the insulating layer has an aspect ratio of more than 1.

16. An electron emission device manufactured by the method of claim 12, wherein at least one of the openings of the insulating layer has an aspect ratio of more than 1.

* * * * *

UNITED STATES PATENT AND TRADEMARK OFFICE

CERTIFICATE OF CORRECTION

PATENT NO. : 7,581,999 B2
APPLICATION NO. : 11/191880
DATED : September 1, 2009
INVENTOR(S) : Kyung-Sun Ryu et al.

It is certified that error appears in the above-identified patent and that said Letters Patent is hereby corrected as shown below:

In the Claims

Column 6, Claim 3, line 64 Delete "from" Insert -- form --

Column 8, Claim 14, line 24 Delete "opening" Insert -- openings --

Signed and Sealed this
Twenty-first Day of June, 2011

David J. Kappos

David J. Kappos
*Director of the United States Patent and Trademark Office*